United States Patent [19]

Sluyterman

[11] Patent Number: 4,754,189

[45] Date of Patent: Jun. 28, 1988

[54] COLOR TELEVISION DISPLAY TUBE WITH COMA CORRECTION

[75] Inventor: Albertus A. S. Sluyterman, Eindhoven, Netherlands

[73] Assignee: U.S. Philips Corporation, New York, N.Y.

[21] Appl. No.: 117,926

[22] Filed: Nov. 2, 1987

Related U.S. Application Data

[63] Continuation of Ser. No. 872,772, Jun. 10, 1986, abandoned.

[30] Foreign Application Priority Data

Apr. 29, 1986 [NL] Netherlands ..... 8601091

[51] Int. Cl.[4] ..... H01J 29/51

[52] U.S. Cl. ..... 313/414; 313/449

[58] Field of Search ..... 313/412, 413, 414, 449

[56] References Cited

U.S. PATENT DOCUMENTS 4,196,370 4/1980 Hughes ..... 313/413

4,396,862 8/1983 Hughes ..... 313/413

*Primary Examiner*—David K. Moore

*Assistant Examiner*—K. Wieder

*Attorney, Agent, or Firm*—Robert J. Kraus

[57] ABSTRACT

A color television display tube comprising an electron gun system (5) of the "in-line" type and an electromagnetic deflection unit. The end of the electron gun system is provided with field shapers comprising, for example, annular elements (34,34') of a material having a high magnetic permeability which are positioned around the two outer beams and are adapted to compensate coma. These elements are located in a more advanced position towards the screen than is usual, in positions where the outer beams have undergone a predeflection of at least 0.5 mm so as to reduce the "green droop" (anisotropic Y-coma) and to reduce the need for a negative 6-polefield. For example, the elements (34, 34') may be located "above" the bottom of the centering bush (28), or the distance between a focusing lens of the electron gun and elements (34, 34') may be more than 10 mm or, the axial position of the elements (34, 34') may coincides with the axial beginning of the turns on the line deflection coil, or the axial beginning may be located closer to the display screen.

5 Claims, 4 Drawing Sheets

COLOR TELEVISION DISPLAY TUBE WITH COMA CORRECTION

This is a continuation of application Ser. No. 872,772 filed June 10, 1986, abandoned.

BACKGROUND OF THE INVENTION

The invention relates to a color television display tube comprising an electron gun system of the "in-line" type. The system is disposed in an evacuated envelope for generating three electron beams whose axes are co-planar and which converge on a display screen provided on a wall of the envelope. The beams are deflected in the operative display tube across the display screen in two mutually perpendicular directions by means of a deflection unit comprising deflection coils producing a first and a second deflection field, the direction of the first deflection field being parallel to the plane. The electron gun system comprises correction elements of a magnetically permeable material positioned around the two outer beams at the end of the system closest to the display screen.

A color television display tube of this type is known from U.S. Pat. No. 4,196,370. A frequent problem in colour television display tubes incorporating an electron gun system of the "in-line" type is what is commonly referred to as the line and field coma error. This error becomes manifest in that the dimensions of the rasters scanned by the three electron beams on the display screen are different. This is due to the eccentric location of the outer electron beams relative to the fields for horizontal and vertical deflection, respectively. The Patent Specification cited above refers to a large number of Patents giving partial solutions. These solutions consist of the use of field shapers. These are magnetic field conducting and/or protective annular and plate-shaped elements mounted on the end of the gun and locally strengthening or weakening the deflection field or the deflection fields along part of the electron beam paths.

In colour television display tubes, various types of deflection units may be used for the deflection of the electron beams. These deflection units in tubes having an "in-line" electron gun system are mostly self convergent. One of the frequently used deflection unit types is what is commonly referred to as the hybrid deflection unit. It comprises a saddle line deflection coil and a toroidal field deflection coil. Due to the winding technique used for manufacturing the field deflection coil it is not possible to make the coil completely self convergent. Usually such a winding distribution is chosen that a certain covergence error remains, which is referred to as coma. This coma error becomes manifest, for example, in a larger raster (horizontal and vertical) for the outer beams relative to the central beam. The horizontal and vertical deflection of the central beam is smaller than that of the outer beams. As has been described, inter alia, in the U.S. Pat. No. 4,196,370 cited above, this may be corrected by providing elements of a material having a high permeability (for example, mu-metal) around the outer beams. The peripheral field is slightly shielded by these elements at the area of the outer electron beams so that these beams are slightly less deflected and the coma error is reduced.

Two problems then present themselves. The first problem is that the shielding of the outer electron beams also results in these beams being deflected to a lesser extent at the area where the field astigmatism is corrected in the field deflection coil. Since the (barrel-shaped=negative 6-pole) vertical deflection field can only perform an astigmatism correction by the grace of pre-deflection, the astigmatism correction of the field deflection coil becomes less. This can be corrected by positioning the electron gun as a whole further away from the screen and hence away from the coil, but this results in a display tube with a greater build-in depth. Another solution may be to provide an extra barrel-shaped component in the deflection field of the field deflection coil, but this causes the need for coma correction to be increased again. A second problem which presents itself is that the correction of the field coma (Y-coma) is anisotropic. In other words, the correction in the corners is less than the correction at the end of the vertical axis. This is caused by the positive "lensing" action of the line deflection coil (approximately quadratic with the line deflection) for vertical beam displacements. (The field deflection coil has a corresponding lensing action, but is does not contribute to the relevant anisotropic effect). The elimination of such an anisotropic Y-coma error by adapting the winding distribution of the coils is a complicated matter and often introduces an anisotropic X-coma.

SUMMARY OF THE INVENTION

It is an object of the invention to provide a colour television display tube in which it is possible to correct the field coma errors on the vertical axis and in the corners to a more equal extent and in which the coma correction per mm of corrected field coma has a reduced influence on the field astigmatism without requiring the winding distribution of the coils to be notably adapted.

To this end a colour television display tube of the type described in the opening paragraph is characterized in that the correction elements are placed in positions in which the outer beams have undergone a substantial pre-deflection. In many cases this pre-deflection will have to be at least 1 mm. In practice very good results were obtained when the correction elements were placed in positions in which the outer beams had undergone a 1 to 2 mm pre-deflection in the vertical direction. As a result the (field shielding) elements are closer to or even in the magnetic deflection field. In this connection a first embodiment of the invention is characterized in that the axial position of the correction elements is not further away from the display screen than the axial position of the gun sided extremity of the deflection coil for the second deflection field.

The invention is based on the recognition that the field-astigmatic effect of the negative 6-pole component in the vertical deflection field only operates by the grace of pre-deflection at the area of this 6-pole and that it is less affected as the correction elements are closer to the screen. The ivention is also based on the recognition that the problem of the anisotropic Y-coma can be reduced by suitabley utilizing the Z dependence of the anisotropic Y-coma.

This dependence implies that as the coma correction is effected at a larger distance (in the Z direction) from the "lens" constituted by the line deflection coil its "lensing" action becomes more effective so that the coma correction acquires a stronger anisotropic character.

In order to place the correction element in a position which is closer to the display screen than is usual, the (conventional) electron gun system can be positioned closer to the display screen. An alternative presented by the invention is to elongate the electron gun system towards the display screen and this in such a manner that the distance between the correction elements and the focusing gap is increased. In conventional systems this distance is less than 10 mm. An embodiment of the invention is characterized in that the correction elements are located at a distance of at least 10 mm and preferably still further away from the focusing gap of the electron gun system. Within the scope of the invention the electron gun system can be elongated in different manners. A practical manner is characterized in that the end of the electron gun system facing the display screen is provided with a centering bush having a closed bottom remote from the display screen and a closed top closer to the screen, each having apertures for passing the electron beams, and in that the correction elements are mounted on the top.

If the correction elements give rise to an overcompensation of the field coma, the invention provides a further correction possibility. It is characterized in that a further correction element is placed around the position of the central beam, which further correction element is located at a greater distance from the display screen than the correction elements around the outer beams.

The display tube according to the invention is very suitable for use in combination with a deflection unit of the hybrid type, particularly when a combination is concerned which should be free from raster correction.

BRIEF DESCRIPTION OF THE DRAWINGS

The invention will now be further described with reference to a drawing in which.

DESCRIPTION OF THE PREFERRED EMBODIMENT

Figure 1:
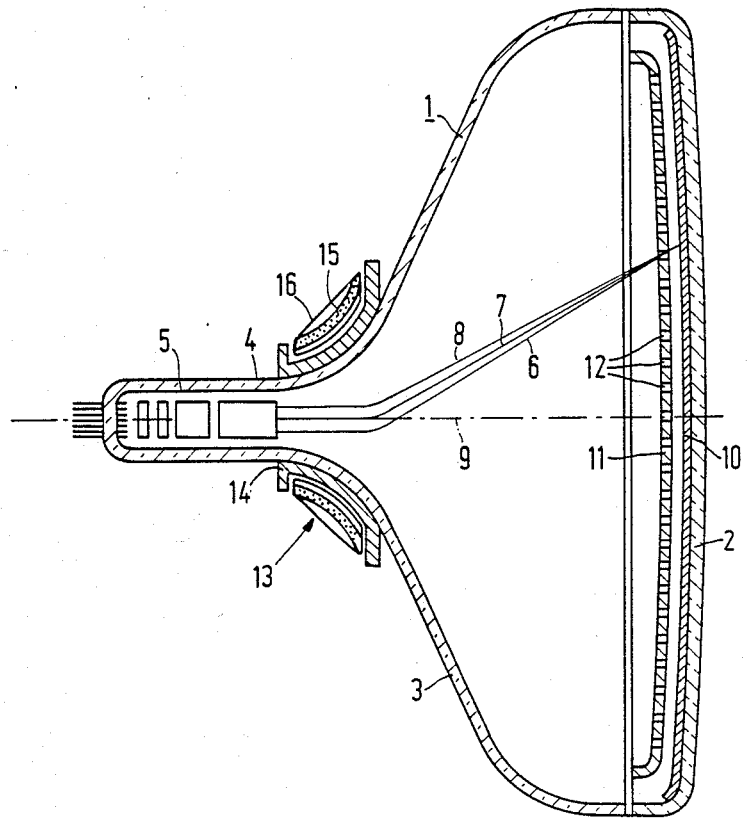
FIG. 1 is a longitudinal section through a display tube according to the invention.

FIG. 1 shows in a longitudinal section a display tube according to the invention. It is a colour television display tube of the "in-line" type. In a glass envelope 1, which is composed of a display window 2, a cone 3 and a neck 4, this neck accommodates an integrated electron gun system 5 generating three electron beams 6, 7, and 8 whose axes are co-planar prior to deflection. The axis of the central electron beam 7 coincides with the tube axis 9. The inside of the display window 2 is provided with a large number of phosphor element triplets. The elements may consist of lines or dots. Each triplet comprises an element consisting of a blue-luminescing phosphor, an element consisting of a green-luminescing phosphor and an element consisting of a red-luminescing phosphor. All triplets combined constitute the display screen 10. The phosphor lines are substantially perpendicular to the said plane through the beam axes. Positioned in front of the display screen is a shadow mask 11 having a very large number of elongated apertures 12 which allow the electron beams 6, 7 and 8 to pass, each beam inpinging only on phosphor elements of one colour. The three co-planar electron beams are deflected by a system of deflection coils 13 comprising a line deflection coil 14, a yoke ring 15 and a field deflection coil 16.

Figure 2:
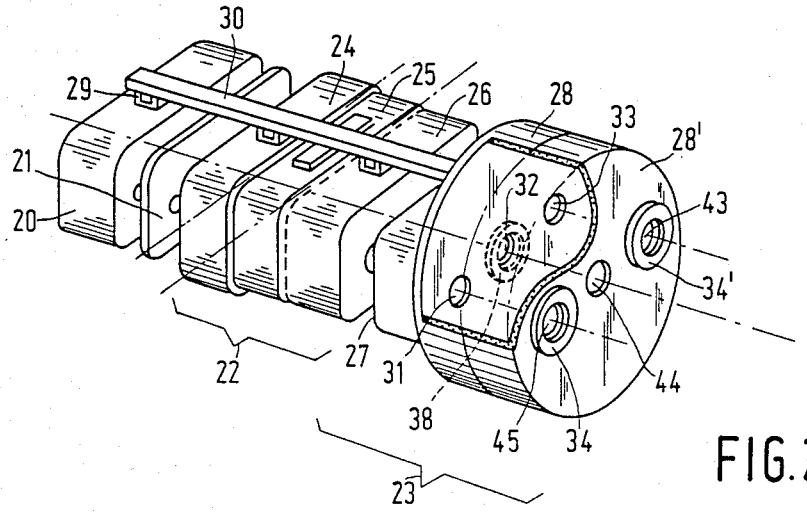
FIG. 2 is a perspective elevational view of an electron gun system for a tube as shown in FIG. 1.

FIG. 2 is a perspective elevational view of an embodiment of an electron gun system as used in the colour television diplay tube of FIG. 1. The electron gun system has a common cup-shaped control electrode 20 in which three cathodes (not visible in the Figure) are secured, and a common plate-shaped first anode 21. The three electron beams whose axes are co-planar are focused with the aid of the second anode 22 and third anode 23 which are common for the three electron beams. Anode 22 consists of three cup shaped parts 24, 25 and 26. The open ends of parts 25 and 26 are connected together. Part 25 is coaxially positioned relative to part 24. Anode 23 has one cup-shaped part 27 whose bottom, likewise as the bottoms of the other cup-shaped parts, is apertured. Anode 23 also includes a centering bush 28 used for centering the electron gun system in the neck of the tube. This centering bush is provided for that purpose with centering springs not shown. The electrodes of the electron gun system are connected together in conventional manner with the aid of brackets 29 and glass rods 30.

The bottom of the centering bush 28 has three apertures 31, 32 and 33. A mirrored centering bush 42 having a lid with three apertures 43, 44, 45 faces centering bush 28. Substantially annular correction elements 34, 34' are provided around the apertures 43 and 45 for the outer electron beams. The centering bushes 28, 42 are, for example, 6.5 mm deep and have an external diameter of 22.1 mm and an internal diameter of 21.6 mm in a tube having a neck diameter of 29.1 mm. The distance between the centers of two adjoining apertures in the bottom of centring bush 28 is 6.5 mm.

Figure 3A:
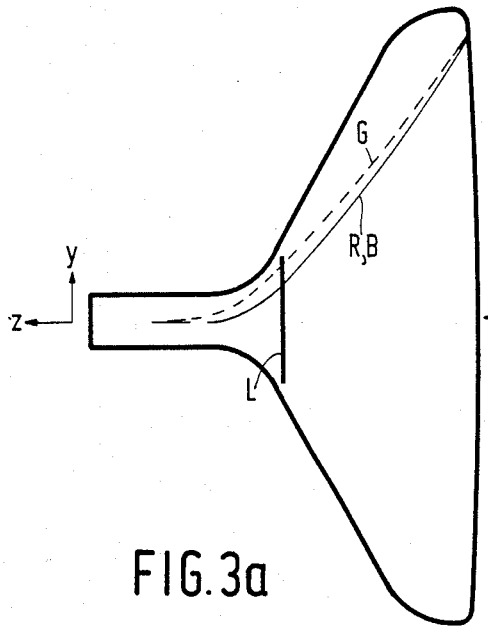
FIG. 3*a* shows the beam path on deflection towards a vertical axis extremity in a conventional display system.

FIG. 3*a* is a side elevation of the three beams upon deflection towards a vertical axis extremity in a conventional display system in which the correction elements are placed on the bottom of centering bush 28. At the rear in the tube red and blue are deflected to a lesser extent than green, so that the beams coincide again on the screen.

Figure 3B:
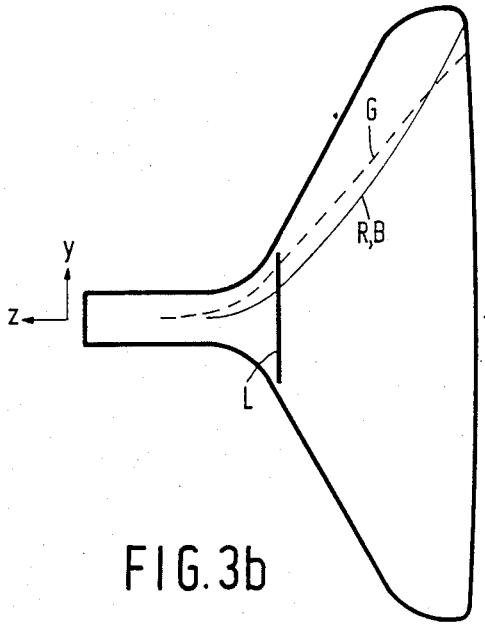
FIG. 3*b* shows the beam path upon deflection towards a screen corner in a conventional display system.

FIG. 3*b* is a side elevation upon deflection towards a screen corner. Due to increasing focusing effect of lens L as a result of the line deflection and the distance between G on the one hand and R and B on the other hand, the green beam on the screen is less far deflected in the corner than are the red and blue beams. This effect with respect to the vertical axis situation is referred to as the "green droop".

Figure 4A:
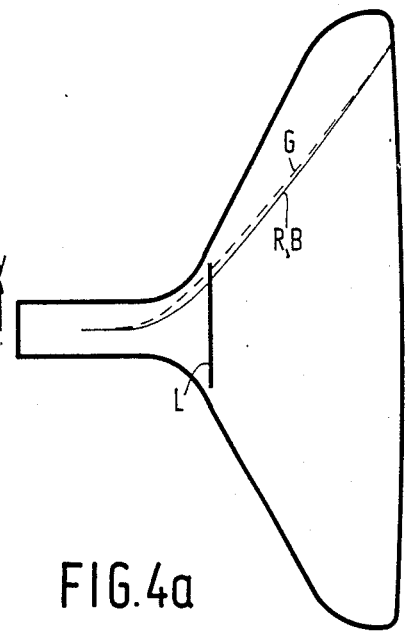
FIG. 4*a* shows the beam path upon deflection towards a vertical axis extremity in a display system according to the invention.

FIG. 4*a* shows analogously to FIG. 3*a* the side elevation of the three beams upon deflection towards a vertical axis extremity in the case of the display system of FIGS. 1 and 2. As compared with the conventional system the correction elements are placed 13 mm to the front. Now again the red and blue beams are deflected to a lesser extent than green, but this in an axial position which is closer to the display screen. The total discrimination as is visible on the screen is equal to that of the original case (FIG. 3*a*), but the discrimination is less at the area of lens L and also at the area of the negative 6-pole component of the field deflection field (sometimes generated by means of a soft magnetic "astigmatism correction" member). As can be seen in FIG. 4*a* the red and blue beams at the area of the coil (=approximately the position of lens L) is more deflected than in the conventional situation (FIG. 3*a*). This extra deflection is of great importance because the field astigmatic effect of a 6-pole field is proportional to the deflection of the beams at the area of this 6-pole. A greater deflection means that there is less vertical 6-pole field required to produce a similar astigmatism effect.

Figure 4B:
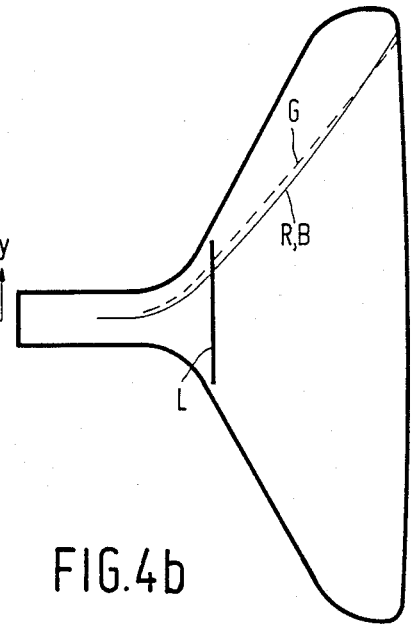
FIG. 4*b* shows the beam path upon deflection towards a screen corner in a display system according to the invention.

FIG. 4*b* shows analogously to FIG. 3*b* the side elevation upon deflection towards the corner of the display screen in the case of the display system of FIGS. 1 and 2. Since at the area of lens L the vertical distance between the green beam on the one hand and the red and blue beams on the other hand has become less with respect to the original situation (FIG. 3*b*), the green droop effect is also reduced. This means that the difference in Y-coma between screen corners and vertical axis has become less.

Figure 5A:
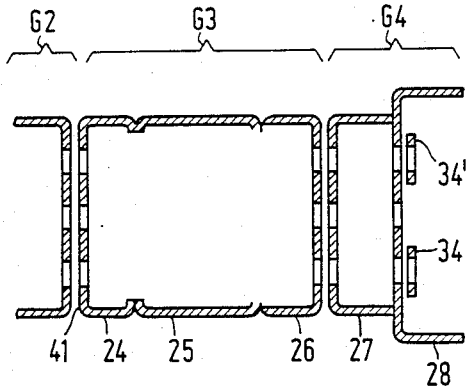
FIG. 5*a* is a longitudinal section through part of a conventional electron gun.

FIG. 5*a* shows the plan view of a conventional coma-correction system. The coma-correcting elements 34, 34' are positioned on the bottom of the centering bush 28.

Figure 5B:
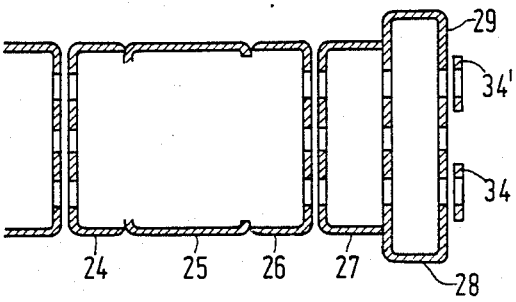
FIGS. 5*b*, 5*c*, 5*d* show three examples of embodiments of electron guns for a colour television display tube according to the invention.

In FIG. 5*b* centering bush 28 has a closed end 29 on which the coma-correction elements 34, 34' are placed. The dimensions of the elements 34 are to be adapted so as to obtain, measured on the screen, an approximately equal coma-correction level as in the case of FIG. 5*a*.

Figure 5C:
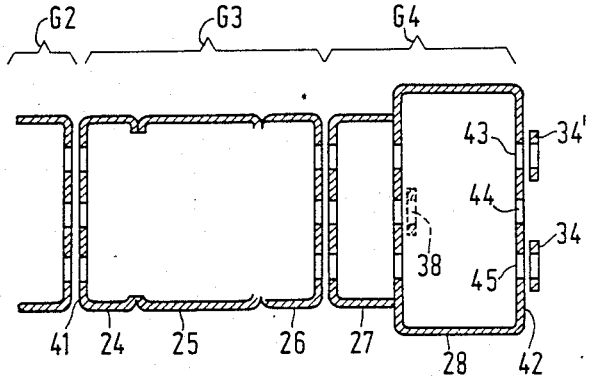

In FIG. 5*c* an inverted cup 42 on which the coma-correcting elements 34, 34' are placed is positioned on the centering bush 28. Also in this case the size of the (annular) elements 34, 34' is adapted to obtain the desired coma-correction level.

Figure 5D:
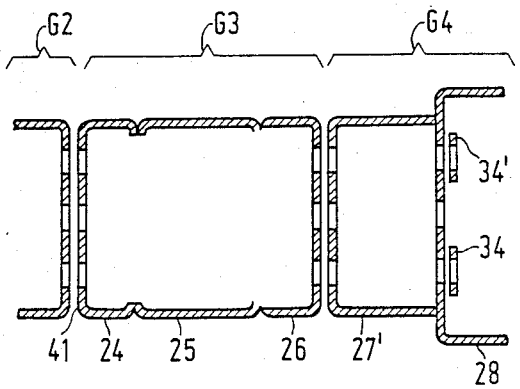

FIG. 5*d* shows a third modification in which the component 27' is elongated and which is no longer equal to component 26. Components 26 and 27 are usually identical in order to cause main lenses which are formed by the gap between 26 and 27 to be symmetrical. The component 27 is considered to be elongated within the scope of coma correction improvement when the distance between centering bush and the focusing gap formed between components 26 and 27 and 26 and 27', respectively, is more than 10 mm. In conventional systems this distance is always less than 10 mm. A common value is approximately 8 mm. In this respect it is to be noted that the gun length is more or less equal for all conventional types of guns, provided that they are operated at the same high voltage both in the case of mini neck tubes and narrow neck tubes.

Figure 6A:
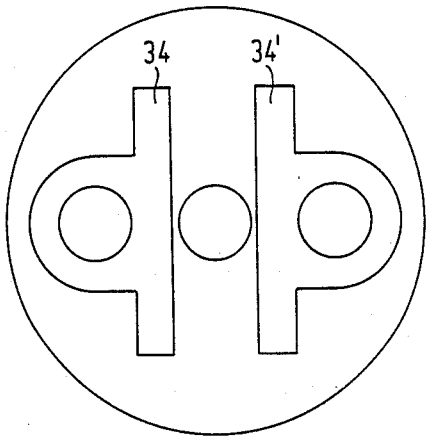
FIGS. 6*a*, 6*b* shows two modifications of coma correction elements which may be used within the scope of the invention.
Figure 6B:
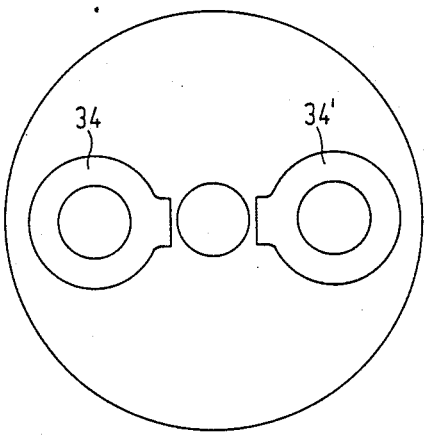

FIGS. 6*a* and 6*b* show that the elements 34, 34' do not necessarily require a purely annular shape. The shapes as shown in 6*a* and 6*b* are intended to be able to correct line coma effects.

What is claimed is:

1. A color display tube comprising an envelope containing a display screen and an electron gun system for producing along a longitudinal axis of the tube a central electron beam and first and second outer electron beams having respective axes which lie in a single plane and converge toward a point on the screen, and further comprising deflection means for producing within the envelope a field deflection field for deflecting the electron beams in a Y-direction perpendicular to said plane and a line deflection field for deflecting the electron beams in an X-direction parallel to said plane, said fields including a region in which Y-direction astigmatism of the field deflection field is corrected, the electron gun system including an end from which the electron beams exit before entering said region;

characterized in that said end of the electon gun system includes first and second deflection field shaping means of magnetically-permeable material arranged adjacent the respective outer electron beams for correcting field coma, said field shaping means being disposed at a position along the tube axis where the outer electron beams have already undergone substantial deflection in the Y-direction, thereby augmenting the astigmatic correction in said field region.

2. A color display tube comprising an envelope containing a display screen and an electron gun system for producing along a longitudinal axis of the tube a central electron beam and first and second outer electron beams having respective axes which lie in a single plane and converge toward a point on the screen, and further comprising deflection means for producing within the envelope a field deflection field for deflecting the electron beams in a Y-direction perpendicular to said plane and a line deflection field for deflecting the electron beams in an X-direction parallel to said plane, said fields including a region in which Y-direction astigmatism of the field deflection field is corrected and in which a positive lensing action of the line deflection field is concentrated, the electron gun system including an end from which the electron beams exit before entering said region;

characterized in that said end of the electron gun system includes first and second deflection field shaping means of magnetically-permeable material arranged adjacent the respective outer electron beams for correcting field coma, said field shaping means being disposed at a position along the tube axis where:

(1) the outer electron beams have already undergone substantial deflection in the Y-direction, thereby augmenting the astigmatic correction in said field region; and (2) the distance between the field shaping means and said deflection field region is minimized, thereby reducing an anisotropic affect on field coma correction caused by the positive lensing action of the line deflection field.

3. A color display tube as in claim 1 or 2 where the deflection means includes a line deflection coil having a first end closer to the screen and having a second end remote from the screen, the axial position of the field shaping means being no further from the screen than said second end of said line deflection coil.

4. A color display tube as in claim 1 or 2 where the electron gun system includes electrodes defining a gap in which an electron beam focusing field is produced, the field shaping means being located at an axial position which is at least 10 mm from said gap.

5. A color display tube as in claim 4 where said end of the electron gun system includes a bush for centering the system in a neck portion of the tube, said bush having an end further from the screen which is closed by a first plate with respective apertures for passing the central and outer electron beams, and having an end closer to the screen which is closed by a second plate having respective apertures for passing the central and outer electron beams, said first and second deflection field shaping means being disposed adjacent the outer apertures on said second plate.

* * * * *